US006851468B2

(12) United States Patent
Kaspar et al.

(10) Patent No.: US 6,851,468 B2
(45) Date of Patent: Feb. 8, 2005

(54) HEAT EXCHANGER

(75) Inventors: Martin Kaspar, Esslingen (DE); Michael Kohl, Cleebronn (DE); Gerrit Woelk, Stuttgart (DE)

(73) Assignee: BEHR GmbH & Co., Stuttgart (DE)

( * ) Notice: Subject to any disclaimer, the term of this patent is extended or adjusted under 35 U.S.C. 154(b) by 0 days.

(21) Appl. No.: 10/289,264

(22) Filed: Nov. 7, 2002

(65) Prior Publication Data

US 2003/0085026 A1 May 8, 2003

(30) Foreign Application Priority Data

Nov. 8, 2001 (DE) ..... 101 54 891
Jul. 3, 2002 (DE) ..... 102 29 831

(51) Int. Cl.[7] ..... F28D 1/06
(52) U.S. Cl. ..... 165/132; 62/509; 228/135; 228/138
(58) Field of Search ..... 165/132, 173, 165/174; 62/509; 228/135, 138

(56) References Cited

U.S. PATENT DOCUMENTS 5,228,315 A * 7/1993 Nagasaka et al. ..... 62/509
5,363,910 A * 11/1994 Baba et al. ..... 165/153
5,535,819 A * 7/1996 Matsuura ..... 165/149
5,537,839 A 7/1996 Burk et al.
5,546,761 A * 8/1996 Matsuo et al. ..... 62/509
5,713,217 A * 2/1998 Baba ..... 62/509
6,397,627 B1 * 6/2002 Aki et al. ..... 62/509
6,430,945 B1 8/2002 Haussmann
6,446,714 B1 9/2002 Kaspar et al.

FOREIGN PATENT DOCUMENTS

DE 42 38 853 A1 5/1994
DE 198 48 744 A1 4/2000
DE 100 07 159 A1 9/2000
DE 100 39 260 A1 3/2001

* cited by examiner

*Primary Examiner*—Allen J. Flanigan
(74) *Attorney, Agent, or Firm*—Foley & Lardner LLP

(57) ABSTRACT

The invention relates to a heat exchanger, in particular a refrigerant condenser, especially for a motor vehicle air-conditioning unit. The heat exchanger is comprised of a block of tubes and fins and of collecting tubes which are arranged on both sides and receive the ends of the tubes, and of a collector which is arranged parallel to a collecting tube. A method for manufacturing the heat exchanger is also disclosed.

17 Claims, 4 Drawing Sheets

HEAT EXCHANGER

CROSS-REFERENCE TO RELATED PATENT APPLICATIONS

The right of priority under 35 U.S.C. §119(a) is claimed based on Federal Republic of Germany Priority Application 101 54 891.5, filed Nov. 8, 2001, and Federal Republic of Germany Priority Application 102 29 831.9, filed Jul. 3, 2002, the disclosures of which, including the specification, drawings, claims and abstract of each, are incorporated herein by reference.

BACKGROUND OF THE INVENTION

The present invention relates to a heat exchanger, in particular, a refrigerant condenser, and more particularly to such a heat exchanger for motor vehicle air-conditioning units. The heat exchanger includes a block of tubes and fins and collecting tubes which are arranged on both sides and receive the ends of the tubes of the block of tubes. It also includes a collector which is arranged parallel to one of the collecting tubes and is in refrigerant communication with the collecting tube via two overflow openings.

Such collectors can be formed from a first tube, for example, a welded tube, and a second tube piece, for example, a shorter one, which comprises the two overflow openings. Such a condenser is disclosed in commonly assigned DE-A 198 48 744. The collector can also be made in one piece from one tube, in which case the tube can be formed from one part or at least two axial tube shells.

The condenser known from DE 1 98 48 744 is distinguished, inter alia, by the fact that the collector is designed in two parts. It consists, on the one hand, of a welded tube which in terms of its dimensioning, particularly its wall thickness, is adapted to the prevailing operating pressure, and, on the other hand, of a short tube piece which is designed as an extrusion part and has a greater wall thickness. The latter is expedient so as to be able to better machine this part.

The collecting tube and the collector are two separate structural components which can be connected to one another, preferably brazed to one another. For such brazing, it is expedient to fix both parts to one another before the whole condenser is placed in the brazing furnace for brazing. In the known condenser, this fixing is done by tack-welding. For a brazed condenser, such an operation is not typical, i.e. it is disadvantageous from the point of view of production technology, since it is expensive.

SUMMARY OF THE INVENTION

One object of the present invention is to provide an improved heat exchanger, particularly one having an improved connection of collecting tube and collector in a condenser of the type set out in the introduction, such that a construction is obtained which is suitable for brazing and which does not require fixing of both parts by tack-welding. A further object of the invention is to provide an improved method for producing the heat exchanger of the invention.

In accordance with one aspect of the present invention, there has been provided a heat exchanger suitable for use as a refrigerant condenser, comprising: a block of tubes and fins and collecting tubes which are arranged on both sides and receive the ends of the tubes; a collector which is arranged adjacent and parallel to one collecting tube and is in refrigerant communication with the collecting tube via two overflow openings, said collector comprising a tube; and means, including at least one additional structural part of the heat exchanger, for producing a temporary mechanical engagement between the collector and the adjacent collecting tube, the engagement producing means being sufficient to hold the collector and collecting tube in relative position before final permanent connection thereof.

In accordance with another aspect of the invention, there is provided a method of manufacturing a heat exchanger suitable for use as a refrigerant condenser, comprising: arranging in parallel and opposite to one another a pair of collecting tubes which contain spaced apertures in the sides facing one another; inserting the ends of tubes of a block of tubes into the apertures of the collecting tubes; arranging adjacent and parallel to one collecting tube a collector which comprises a tube and which contains two overflow openings and is in refrigerant communication with the collecting tube via the overflow openings; producing a temporary mechanical engagement between the collector and the adjacent collecting tube by means of at least one additional structural part of the heat exchanger, said engagement being sufficient to hold the collector and collecting tube in relative position before final permanent connection thereof; and producing a final permanent connection between at least the collector and the collecting tube.

According to still another aspect of the invention, there has been provided an automotive air-conditioning system, as well as a vehicle containing such an air-conditioning system, in which the condenser in the system comprises a heat exchanger according to the invention.

Further objects, features and advantages of the present invention will become apparent from the detailed description of preferred embodiments that follows, when considered together with the accompanying figures of drawing.

DETAILED DESCRIPTION OF PREFERRED EMBODIMENTS

According to the invention, the collecting tube and collector are fixed relative to one another via a cover and are positioned in such a way that they can then be brazed without further fixing aids. The cover is, on the one hand, pressed into the tube end of the collector and, on the other hand, engages with a lateral extension, such as a cap, around the adjacent collecting tube. Both the closure part pressed into the tube end and also the cap-shaped extension are brazed to the two tube ends so that a secure connection between collector and collecting tube is then produced. By means of this cover, therefore, a construction is made available which is expedient for brazing, so that it is possible to dispense with further fixing means, such as tack-welding.

According to one advantageous embodiment of the invention, the collecting tube is designed in two parts, i.e., it has, on the one hand, a base part with apertures for the flat tubes and, on the other hand, a cover part which is brazed to the base part via two longitudinal brazings. Collar-shaped apertures are introduced into the cover part and engage in the overflow openings of the tube piece of the collector and thus also provide for fixing of these two parts even before the brazing. The collar-shaped apertures are in this case designed as peripheral collars which, along at least a partial area of their extent, protrude in the direction of the collector or part of the collector.

In a further advantageous embodiment of the invention, the tube piece which is preferably formed by extrusion has a bearing surface on which the cover part of the collecting tube fits closely with its contour, so that a contact surface is formed for brazing both parts.

The projections or apertures arranged on the collecting tube engage in the overflow openings in such a way that they act as a means of fixing both parts and, if appropriate, additionally form a defined brazing gap for a seal brazing. It is also advantageous if the match between bores and projections or apertures is designed as a clamp connection and thus effects, in addition to a form fit, also a force fit or friction fit.

The condenser including collector can thus be brazed in the brazing furnace without a brazing device or tack-welding. The projections or apertures can be produced particularly easily by punching/embossing if the collecting tube is designed in two parts, because then there is enough space for the punch and/or the embossing tool.

Figure 1:
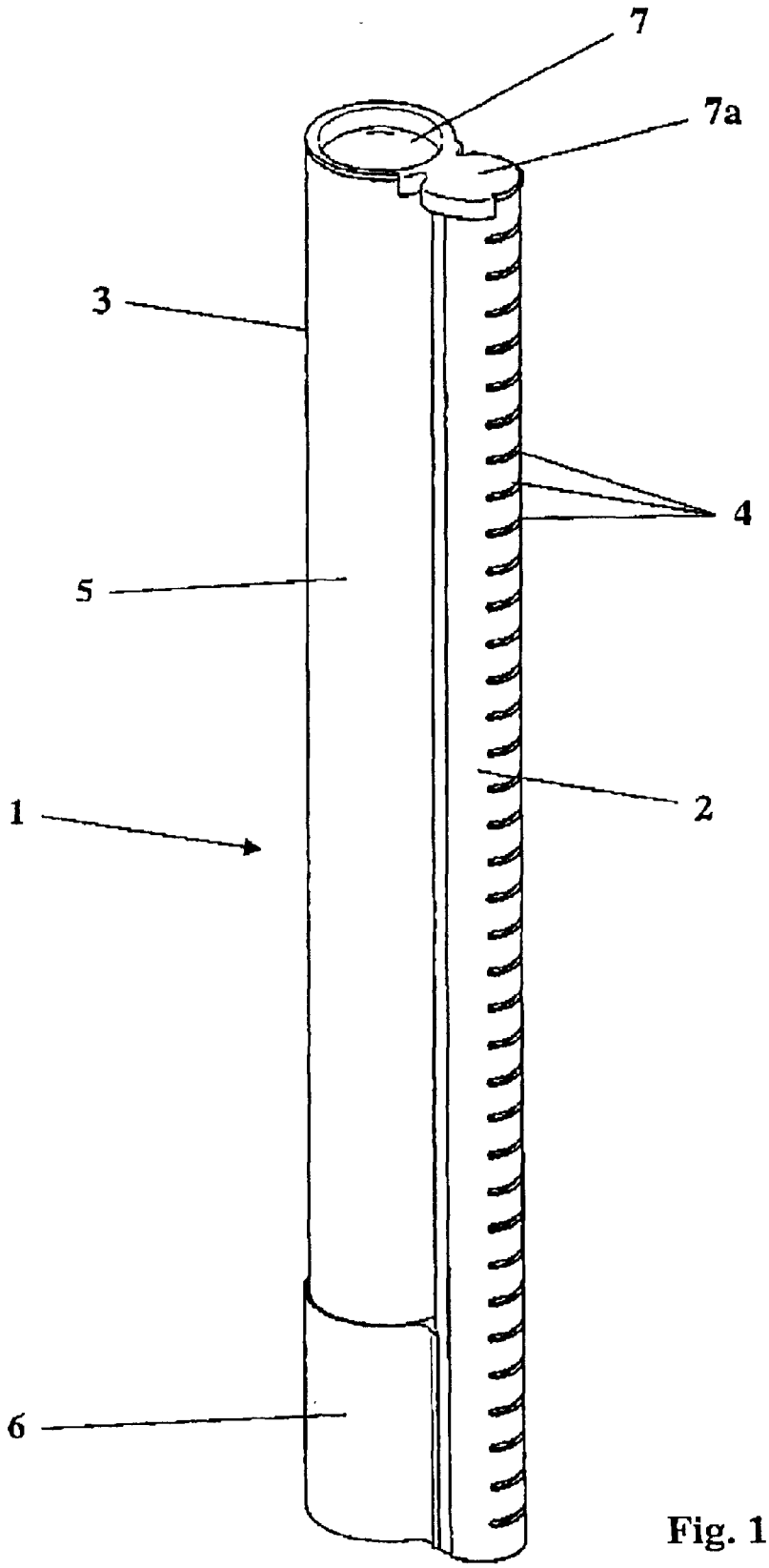
FIG. 1 is a perspective overall view of the unit comprising collecting tube and collector.

FIG. 1 shows a structural unit 1 consisting of a collecting tube (header) 2 and of a collector 3 for a refrigerant condenser for a motor vehicle air-conditioning unit (of conventional design and thus not shown in more detail). Such condensers in which the collector is integrated with the collecting tube or with the entire condenser are known from the commonly assigned DE-C 42 38 853 (corresponding to U.S. Pat. No. 5,537,839), the content of which is hereby incorporated by reference into the disclosure of the present application. Reference is made to this type of construction below.

The collecting tube 2 has, along its entire length, slot-shaped apertures 4 which receive tubes (not shown), such as flat tubes, of a block of tubes and fins of the condenser. The tube ends are brazed in these apertures. The collector 3 is made up of two parts, namely a thin-walled tube 5, which can for example be welded or brazed or otherwise connected, and of a short tube piece 6 designed as an extrusion part. Arranged at the upper end of the tube 3 there is a cover 7 which, on the one hand, closes off the tube 3 and, on the other hand, engages around and over the collecting tube 2 via a cap-like extension part 7*a*.

Figure 2:
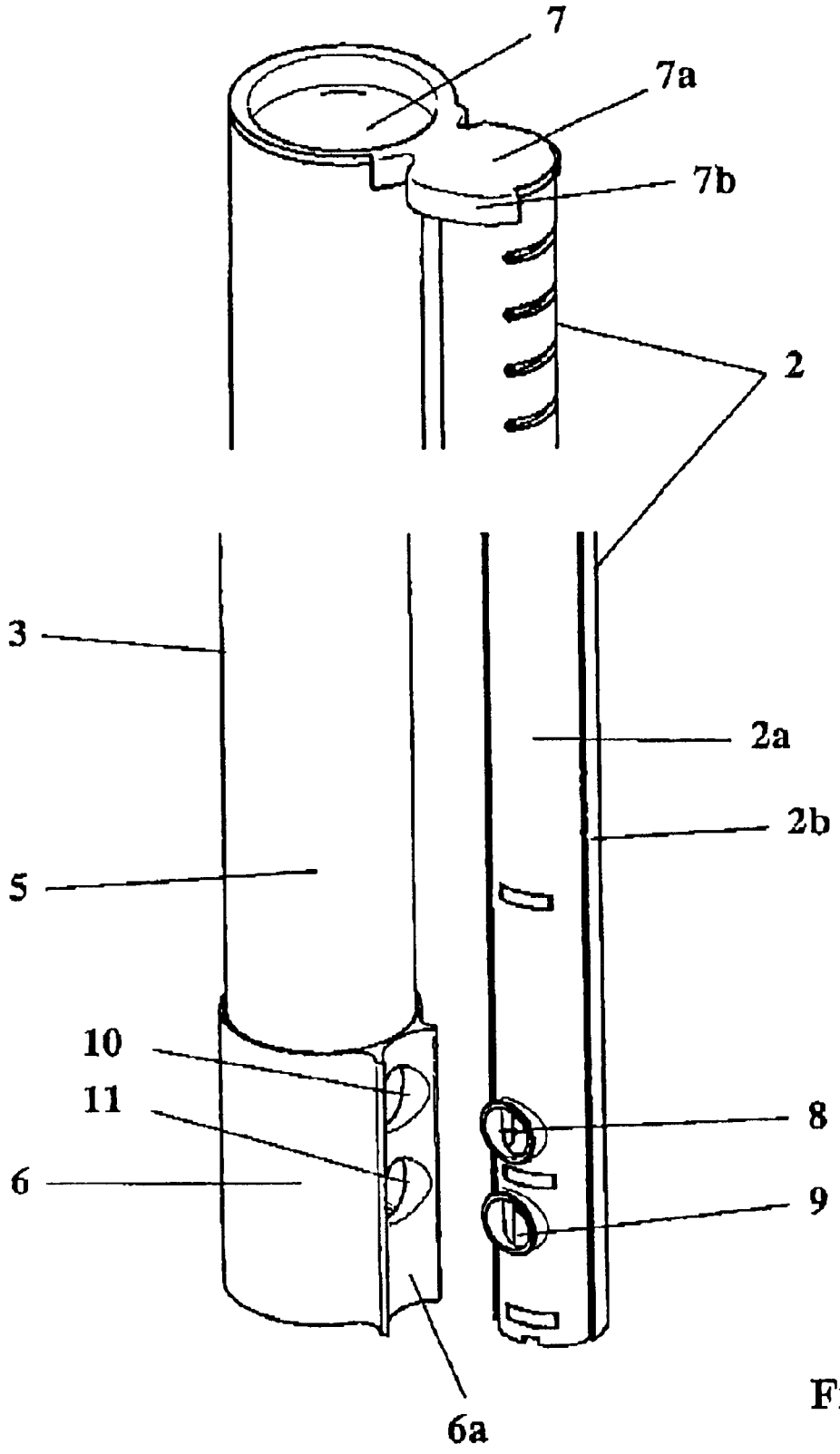
FIG. 2 is an exploded view of the unit comprising collecting tube and collector.

FIG. 2 shows the structural unit 1 according to FIG. 1 partly in an exploded representation, with the collecting tube 2 and the collector 3 being shown as separate parts in the lower part of the drawing. The collecting tube has a cover part 2*a* which in its lower area has two collar-shaped apertures 8 and 9. Corresponding to these apertures 8 and 9, the tube piece 6 has two bores 10 and 11, which in terms of their internal diameter correspond to the external diameter of the collars 8 and 9. Since the collecting tube 2 is designed in two parts, that is to say consists of the base part 2*b* and the cover part 2*a*, the collars 8 and 9 can be relatively easily produced by a punching/embossing operation. The tube piece 6 has a concave bearing surface 6*a* which is adapted to the external contour of the cover part 2*a*.

Figure 2A:
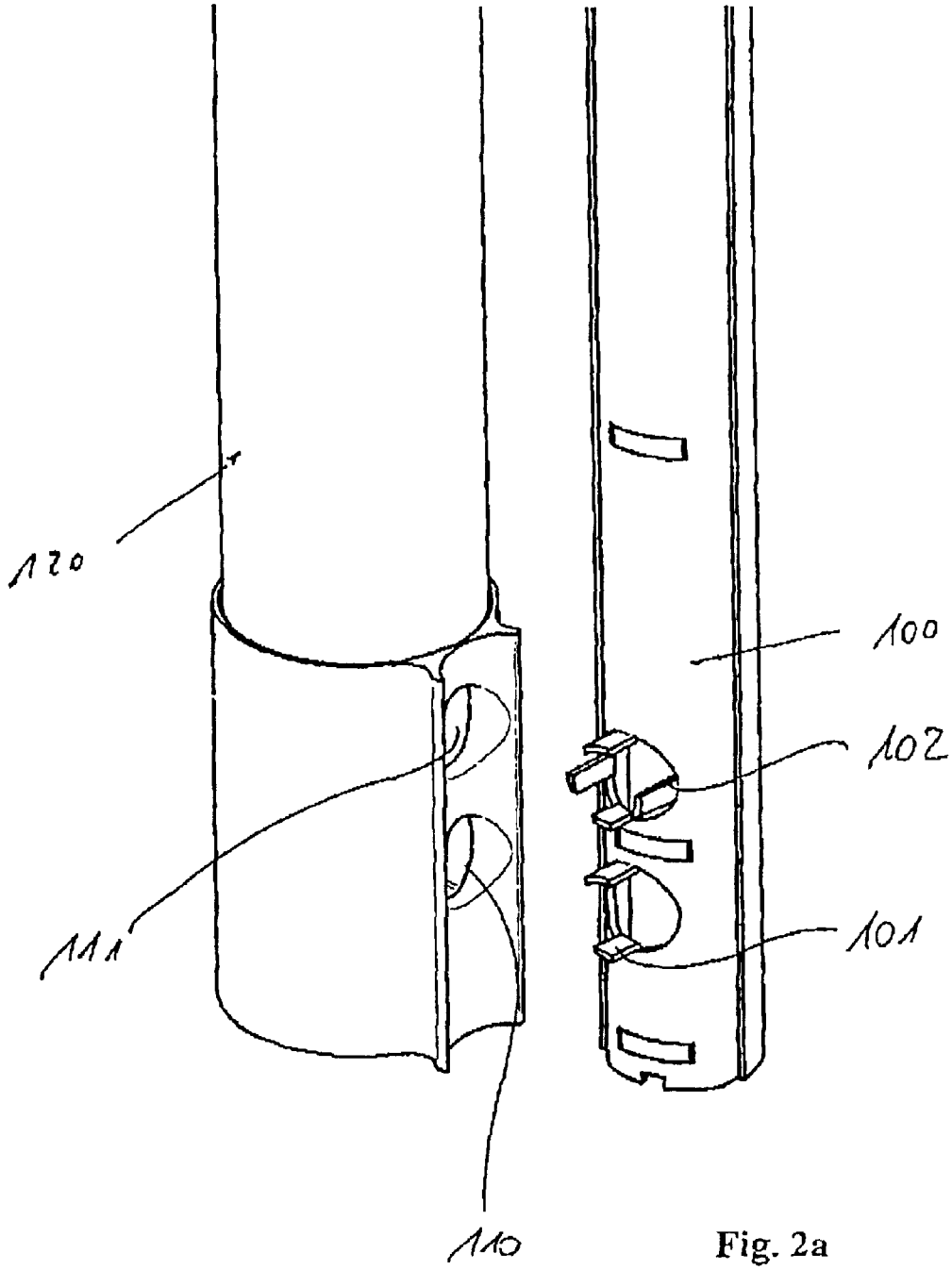
FIG. 2*a* is a detailed view of a portion of the device of the invention.

FIG. 2*a* shows a further illustrative embodiment of the invention in which, instead of the circular apertures 8, 9 in FIG. 2, only projections 101, 102 are provided in the shell 100 of the collecting tube. The projections are here arranged in such a way that they engage in the openings 110, 111 of the collector 120 and fix the latter to the collecting tube 100. Two projections 101 lying opposite one another can advantageously be provided in this case. In another illustrative embodiment, it is also possible to provide more than two projections per fluid connection between collecting tube and collector, such as is shown for example for the projections 102 and the opening 111. Four projections arranged in a star shape are provided here.

In a further illustrative embodiment not shown, only one projection is provided on the collecting tube 100 for each opening 110, 111, these engaging in the openings in such a way that they fix the collecting tube and collector relative to one another.

Figure 3A:
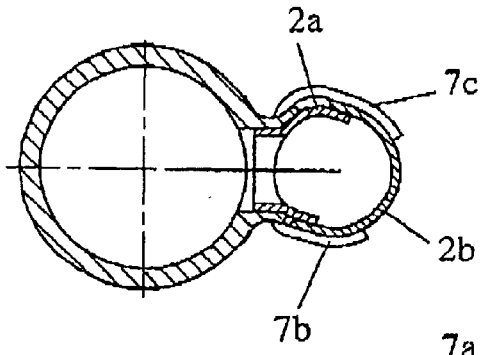
FIG. 3*a* is a lateral cross-sectional view taken along the line I—I through the unit according to FIG. 3.
Figure 3:
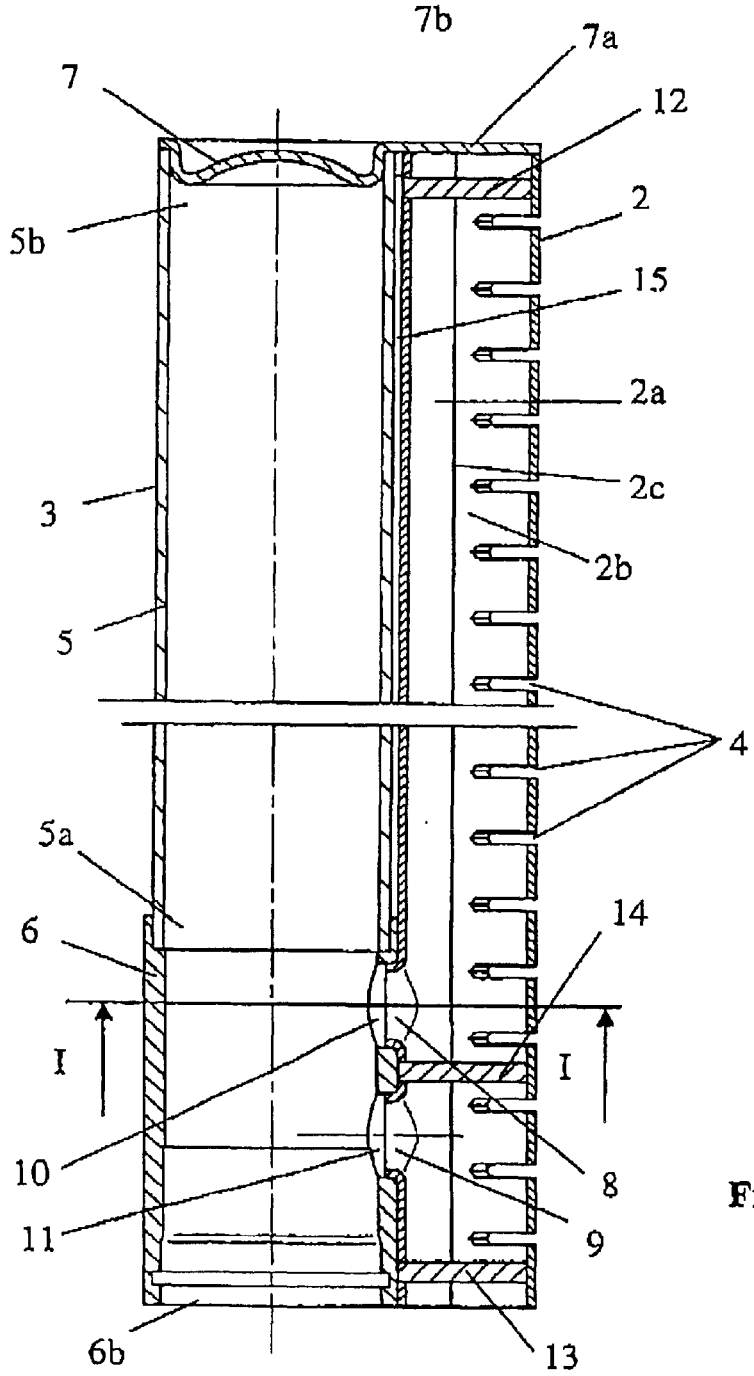
FIG. 3 is an axial cross-sectional view taken through the unit comprising collecting tube and collector.

FIG. 3 shows a cross-sectional view through the structural unit 1 according to FIG. 1 and FIG. 2, the same reference numerals being once again used for the same components. The tube 5 is a welded aluminum tube and is made from a semi-finished material. In terms of its wall thickness, it complies with the operating pressure occurring, and thus has a minimum weight. This tube 5 is fitted with its end 5*a* into the tube piece 6 and is brazed to the latter. The tube piece 6 is produced as an extruded part and has two bores 10 and 11 in which the collars 8 and 9 of the collecting tube 2 engage. Thus, even before the brazing, the collars 8 and 9 also serve to fix the collecting tube 2 relative to the collector 3 and relative to the tube piece 6. As has already been mentioned, the collecting tube 2 is designed in two parts and consists of a cover part 2*a* and a base part 2*b* into which slots 4 are punched. As can be seen from FIG. 3*a*, base part 2*b* and cover part 2*a* are designed roughly as half shells and are brazed to one another in the area of a longitudinal brazing 2*c* (FIG. 3). The collecting tube 2 is closed off at the ends by a cover 12 and cover 13, respectively. A separating wall 14 is situated between the two overflow openings 10 and 11 in the collecting tube 2. The base 6*a* of the tube piece 6 and of the collector 3 is closed off by a closure stopper (not shown), for example, according to commonly assigned DE-A 100 39 260, the disclosure of which is hereby incorporated by reference. The upper tube end 5*b* of the collector 3 is closed off by the cover 7 which is pressed like a stopper into the tube end 5*b* and held there by a force fit. The cover 7 has a laterally protruding extension 7*a* which extends across the entire end face of the collecting tube 2. Flaps 7*b* (FIG. 2 and FIG. 3*a*) and 7*c* are angled off from the end part 7*a*; their shape corresponds to the circumference of the collecting tube 2 and they bear tightly on the outer face of the collecting tube 2.

When assembling the two tubes 2 and 3, they are first positioned in such a way that the collars 8 and 9 are brought into engagement with the bores 10 and 11. Both tubes 2 and 3 thus lie approximately parallel to one another. In the next assembly step, the cover 7 can be pressed into the tube end 5*b*; at the same time the cap-like extension piece 7*a* engages with its two flaps 7*b* and 7*c* around the end of the collecting tube 2 and fixes the latter in its position. Since the collars 8 and 9 likewise are slightly over-dimensioned in relation to the bores 10 and 11, a clamp fit is also obtained there so that both tubes 2 and 3 are fixed relative to one another. After completion to give a complete condenser, this structural unit 1 can be brazed in one operation in the furnace together with the other parts of the condenser, which are likewise made of an aluminum alloy. After this brazing, the cover 7 forms a sealed closure of the tube 3, and the collars 8 and 9 form a sealed connection with the bores 10 and 11.

Situated between the tubes 5 and 2 and the latter's cover part 2*a* there is a gap 15 which corresponds approximately to the wall thickness of the tube 5.

It should be noted that in principle one of the two fixing measures mentioned above—whether the cover 7, 7*a* or the apertures 8, 9—is sufficient by itself, or together with another fixing means, to permit satisfactory brazing.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A heat exchanger suitable for use as a refrigerant condenser, comprising:

a block of tubes and fins and collecting tubes which are arranged on both sides and receive the ends of the tubes;

a collector which is arranged adjacent and parallel to one collecting tube and is in refrigerant communication with the collecting tube via two overflow openings, said collector comprising a tube; and means, including at least one additional structural part of the heat exchanger, for producing a temporary mechanical engagement between the collector and the adjacent collecting tube, said engagement producing means being sufficient to hold the collector and collecting tube in relative position for final permanent connection thereof, wherein the engagement producing means comprises (1) a cover for covering one end of the collector, the cover including a lateral extension part, and wherein the cover with the extension part is connected both to the tube of the collector and also to the adjacent collecting tube and (2) at least one of apertures and projections which engage in the overflow openings of the collector.

2. A heat exchanger as claimed in claim 1, wherein the cover includes a closure part which is pressed into the tube end.

3. A heat exchanger as claimed in claim 1, wherein the lateral extension piece comprises lateral flaps which engage around the collecting tube and are brazed to the latter.

4. A heat exchanger as claimed in claim 1, wherein the collecting tube comprises a longitudinal cover part and a longitudinal base part.

5. A heat exchanger as claimed in claim 1, wherein the collector further comprises a tube piece attached axially to the tube, and the tube piece includes a bearing surface adapted to the outer contour of the collecting tube.

6. A heat exchanger as claimed in claim 1, wherein the overflow openings comprise bores or punched holes.

7. A heat exchanger as claimed in claim 1, wherein the apertures comprise peripheral collars which are engagable with a form fit and/or force fit into the openings.

8. A heat exchanger as claimed in claim 1, wherein the projections comprise parts which are oriented substantially perpendicular to the longitudinal axis of the collector and which are engagable with a form fit and/or force fit into the openings.

9. A heat exchanger as claimed claim 1, wherein the apertures and/or projections cooperate with the overflow openings to produce a preliminary fixing of collector and collecting tube prior to permanent connection of the heat exchanger parts.

10. A heat exchanger as claimed in claim 1, wherein the collecting tube is brazed tightly into the overflow openings by way of the apertures or projections.

11. A heat exchanger as claimed in claim 1, wherein the collecting tube comprises a longitudinal cover part and a longitudinal base part, and wherein the apertures and/or projections are arranged in the cover part.

12. A heat exchanger as claimed in claim 1, wherein the apertures and/or projections are produced by deep-drawing or punching/embossing.

13. In an automotive air-conditioning system comprising a refrigerant condenser, the condenser in the system comprising a heat exchanger as defined by claim 1.

14. A method of manufacturing a heat exchanger suitable for use as a refrigerant condenser, comprising:

arranging in parallel and opposite to one another a pair of collecting tubes which contain spaced apertures in the sides facing one another;

inserting the ends of tubes of a block of tubes into the apertures of the collecting tubes;

arranging adjacent and parallel to one collecting tube a collector which comprises a tube and which contains two overflow openings and is in refrigerant communication with the collecting tube via the overflow openings;

producing a temporary mechanical engagement between the collector and the adjacent collecting tube by means of at least one additional structural part of the heat exchanger, wherein the at least one additional structural part comprises a cover member for the collector, the cover member having a lateral extension for engaging with the collecting tube, said engagement being sufficient to hold the collector and collecting tube in relative position before final permanent connection thereof; and producing a final permanent connection between at least the collector and the collecting tube.

15. A method as claimed in claim 14, wherein the at least one additional structural part comprises at least one aperture and/or projection that engages in the overflow openings of the collector.

16. A method as claimed in claim 14, wherein the step of producing the final permanent connection comprises brazing.

17. A method as claimed in claim 15, wherein the collecting tube comprises a longitudinal cover part and a longitudinal base part and the method further comprises punching or embossing the apertures and/or projections in the cover part prior to assembly of the collecting tube.

* * * * *